United States Patent [19]

Benbassat

[11] Patent Number: 4,912,768

[45] Date of Patent: Mar. 27, 1990

[54] SPEECH ENCODING PROCESS COMBINING WRITTEN AND SPOKEN MESSAGE CODES

[75] Inventor: Gerard V. Benbassat, St. Paul, France

[73] Assignee: Texas Instruments Incorporated, Dallas, Tex.

[21] Appl. No.: 266,214

[22] Filed: Oct. 28, 1988

Related U.S. Application Data

[63] Continuation of Ser. No. 657,714, Oct. 4, 1984, abandoned.

[30] Foreign Application Priority Data

Oct. 14, 1983 [FR] France ..... 83 16392

[51] Int. Cl.[4] ..... G10L 5/04

[52] U.S. Cl. ..... 381/52

[58] Field of Search ..... 381/51–53, 381/41–45, 36–40; 364/513.5

[56] References Cited

U.S. PATENT DOCUMENTS

| | | | |
|---|---|---|---|
| 4,489,433 | 12/1984 | Suehiro et al. | 381/41 |
| 4,685,135 | 8/1987 | Lin et al. | 381/52 |
| 4,700,322 | 10/1987 | Benbassat et al. | 364/513.5 |
| 4,731,846 | 3/1988 | Secrest et al. | 381/49 |
| 4,731,847 | 3/1988 | Lybrook et al. | 381/51 |

FOREIGN PATENT DOCUMENTS

| | | |
|---|---|---|
| 0042155 | 6/1981 | European Pat. Off. . |
| 0059880 | 2/1982 | European Pat. Off. . |
| 0095139 | 5/1987 | European Pat. Off. . |

OTHER PUBLICATIONS

Sargent; "A Procedure for Synchronizing Continuous Speech with its Corresponding Printed Text", I CASSP 81, Proceedings of the 1981 IEEE International Conference on Acoustics, Speech and Signal Processing, Atlanta, Ga., U.S.A., (Mar. 30–Apr. 1, 1981), pp. 129–132.

Flanagan, *Speech Analysis Synthesis and Perception*, 1972, Springer-Verlag, pp. 270–271.

White, "Speech Recognition: A Tutorial Overview", Computer, pp. 40–53.

"A Preliminary Design of a Phonetic Vocoder Based on a Diphone Model"-Schwartz et al., IEEE ICASSP, pp. 32–35 (Apr. 1980).

(List continued on next page.)

*Primary Examiner*—David L. Clark

*Assistant Examiner*—John A. Merecki

*Attorney, Agent, or Firm*—William E. Hiller; N. Rhys Merrett; Mel Sharp

[57] ABSTRACT

A speech encoding process, wherein a first sequence of input data representative of a written version of a message to be coded is encoded to provide a first encoded speech sequence corresponding to the written version of the message to be coded, and a second sequence of input data derived from speech defining a spoken version of the same message is analyzed by a linear predictive codeing analyzer and encoding circuit to provide a second encoded speech sequence corresponding to the spoken version of the message to be coded. The codes of the corresponding written message and the codes of the spoken message are then combined in a control circuit encompassing an adaptation algorithm, and a composite encoded speech sequence is generated corresponding to the message from the combination of the first encoded speech sequence of the written version of the message and encoded intonation parameters of speech included in a portion of the second encoded speech sequence corresponding to the spoken version of the message. In a particular aspect of the speech encoding process, the encoded intonation parameters of speech included in the portion of the second encoded speech sequence corresponding to the spoken version of the message to be coded may be encoded data of the duration and pitch as the portion of the second encoded speech sequence combined with the first encoded speech sequence.

9 Claims, 1 Drawing Sheet

OTHER PUBLICATIONS

"Automatic High-Resolution Labeling of Speech Waveforms"-Bahl et al., IBM Technical Disclosure Bulletin, vol. 23, No. 7B, pp. 3466-3467 (Dec. 1980).

"Application de la Distinction Trait-Indice-Propriete a la Construction d'Un Logiciel Pour la Synthese"-Benbassat et al., Speech Comm. J., vol. 2, No. 2, pp. 141-144 (Jul. 1983).

"A Comparative Performance Study of Several Pitch Detection Algorithms"-Rabiner et al., IEEE Transactions on Acoustics, Speech, and Signal Processing, vol. ASSP-24, No. 5, pp. 399-417 (Oct. 1976).

"Postprocessing Techniques for Voice Pitch Trackers'-'-Secrest et al., Procs. of the ICASSP 1982-Paris, pp, 172-175 (1982).

"Dynamic Programming Algorithm Optimization for Spoken Word Recognition"-Sakoe et al., IEEE Transactions on Acoustics, Speech, and Signal Processing, vol. ASSP-26, No. 1, pp. 43-49 (Feb. 1978).

"Speech Synthesis by Rule: An Acoustic Domain Approach"-Rabiner, Bell System Technical Journal, vol. 47, pp. 171∝37 (Jan. 1968).

"A Model for Synthesizing Speech by Rule"-Rabiner, IEEE Transactions on Audio and Electroacoustics, vol. AU-17, No. 1, pp. 7-13 (Mar. 1969).

"Structure of a Phonological Rule Component for a Synthesis-by-Rule Program"-Klatt, IEEE Transactions on Acoustics, Speech, and Signal Processing, vol. ASSP-24, No. 5, pp. 391-398 (Oct. 1976).

"Terminal Analog Synthesis of Continuous Speech Using the Diphone Method of Segment Assembly'-'-Dixon et al., IEEE Transactions on Audio and Electroacoustics, vol. AU-16, No. 1, pp. 40-50 (Mar. 1968).

"Text-to-Speech Using LPC Allophone Stringing"--Lin et al., IEEE Transactions on Consumer Electronics, vol. CE-27, No. 2, pp. 144-152 (May 1981).

"A Phonetic Dictionary for Demisyllabic Speech Synthesis"-Macchi, Proc. of JCASSP, pp. 565-567 (1980).

SPEECH ENCODING PROCESS COMBINING WRITTEN AND SPOKEN MESSAGE CODES

This application is a continuation of application Ser. No. 657,714, filed Oct. 4, 1984, now abandoned.

The present invention relates to speech encoding.

In a number of applications, a signal representing spoken language is encoded in such a manner that it can be stored digitally so that it can be transmitted at a later time, or reproduced locally by some particular device.

In these two cases, a very low bit rate may be necessary either in order to correspond with the parameters of the transmission channel, or to allow for the memorization of a very extensive vocabulary.

A low bit rate can be obtained by utilizing speech synthesis from a text.

The code obtained can be an orthographic representation of the text itself, which allows for the obtainment of a bit rate of 50 bits per second.

To simplify the decoder utilized in an installation for processing information so coded, the code can be composed of a sequence of codes of phoneme and prosodic markers obtained from the text, thus entailing a slight increase in the bit rate.

Unfortunately, speech reproduced in this manner is not natural and, at best, is very monotonic.

The principal reason for this drawback is the "synthetic" intonation which one obtains with such a process.

This is very understandable when there is considered the complexity of the intonation phenomena, which must not only comply with linguistic rules, but also should reflect certain aspects of the personality and the state of mind of the speaker.

At the present time, it is difficult to predict when the prosodic rules capable of giving language "human" intonations will be available for all of the languages.

There also exist coding processes which entail bit rates which are much higher.

Such processes yield satisfactory results but have the principal drawback of requiring memories having such large capacities that their use is often impractical.

The invention seeks to remedy these difficulties by providing a speech synthesis process which, while requiring only a relatively low bit rate, assures the reproduction of the speech with intonations which approach considerably the natural intonations of the human voice.

The invention has therefore as an object a speech encoding process consisting of effecting a coding of the written version of a message to be coded, characterized in that it includes, in addition, the coding of the spoken version of the same message and the combining, with the codes of the written message, the codes of the intonation parameters taken from the spoken message.

The invention will be better understood with the aid of the description which follows, which is given only as an example, and with reference to the figures.

Figure 1:
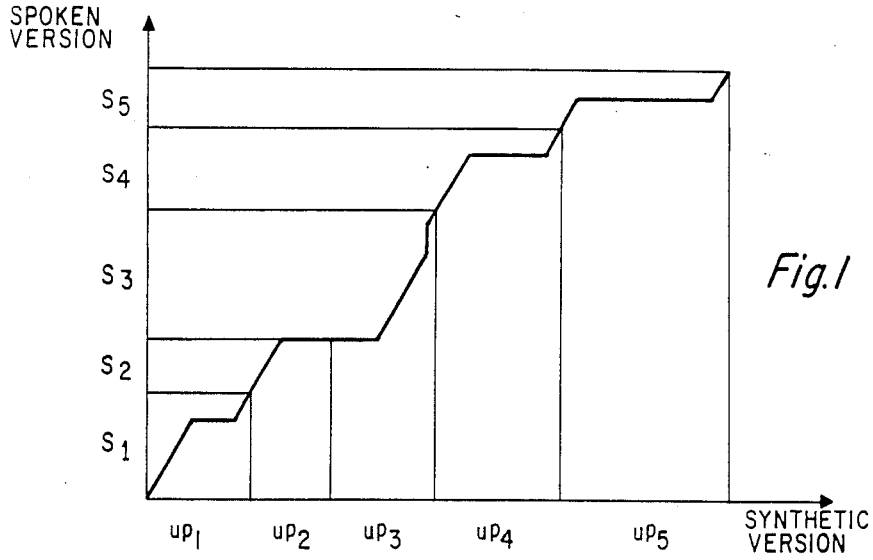
FIG. 1 is a diagram showing the path of optimal correspondence between the spoken and synthetic versions of a message to be coded by the process according to the invention.

The utilization of a message in a written form has as an objective the production of an acoustical model of the message in which the phonetic limits are known.

This can be obtained by utilizing one of the speech synthesis techniques such as:

Synthesis by rule in which each acoustical segment, corresponding to each phoneme of the message is obtained utilizing acoustical/phonetic rules and which consists of calculating the acoustical parameters of the phoneme in question according to the context in which it is to be realized.

G. Fant et al. O.V.E. II Synthesis, Strategy Proc. of Speech Comm. Seminar, Stockholm 1962.

L. R. Rabiner, Speech Synthesis by Rule: An Acoustic Domain Approach. Bell Syst. Tech. J. 47, 17–37, 1968.

L. R. Rabiner, A Model for Synthesizing Speech by Rule. I.E.E.E. Trans. on Audio and Electr. AU 17, pp. 7–13, 1969.

D. H. Klatt, Structure of a Phonological Rule Component for a Synthesis by Rule Program, I.E.E.E. Trans. ASSP-24, 391–398, 1976.

Synthesis by concatenation of phonetic units stored in a dictionary, these units being possibly diphones (N. R. Dixon and H. D. Maxey, Technical Analog Synthesis of Continuous Speech using the Diphone Method of Segment Assembly, I.E.E.E. Trans. AU-16, 40–50, 1968.

F. Emerard, Synthese par Diphone et Traitement de la Prosodie —Thesis, Third Cycle, University of Languages and Literature, Grenoble 1977.

The phonetic units can also be allophones (Kun Shan Lin et al. Text to Speech Using LPC Allophone Stringing IEEE Trans. on Consumer Electronics, CE-27, pp. 144–152, May 1981), demi-syllables (M. J. Macchi, A Phonetic Dictionary for Demi-Syllabic Speech Synthesis Proc. of JCASSP 1980, p. 565) or other units (G. V. Benbassat, X. Delon), Application de la Distinction Trait-Indice-Propriété à la construction d'un Logiciel pour la Synthése. Speech Comm. J. Volume 2, No. 2–3 July 1983, pp. 141–144.

Phonetic units are selected according to rules more or less sophisticated as a function of the nature of the units and the written entry.

The written message can be given either in its regular orthographic or in a phonologic form. When the message is given in an orthographic form, it can be transcribed in a phonologic form by utilizing an appropriate algorithm (B. A. Sherward, Fast Text to Speech Algorithme For Esperant, Spanish, Italian, Russian and English. Int. J. Man Machine Studies, 10, 669–692, 1978) or be directly converted in an ensemble of phonetic units.

The coding of the written version of the message is effected by one of the above mentioned known processes, and there will now be described the process of coding the corresponding spoken message.

The spoken version of the message is first of all digitized and then analyzed in order to obtain an acoustical representation of the signal of the speech similar to that generated from the written form of the message which will be called the synthetic version.

For example, the spectral parameters can be obtained from a Fourier transformation or, in a more conventional manner, from a linear predictive analysis (J. D. Markel, A. H. Gray, Linear Prediction of Speech-Springer Verlag, Berlin, 1976).

These parameters can then be stored in a form which is appropriate for calculating a spectral distance between each frame of the spoken version and the synthetic version.

For example, if the synthetic version of the message is obtained by concatenations of segments analysed by linear prediction, the spoken version can be also analysed using linear prediction.

The linear prediction parameters can be easily converted to the form of spectral parameters (J. D. Markel, A. H. Gray) and an euclidian distance between the two sets of spectral coefficients provides a good measure of the distance between the low amplitude spectra.

The pitch of the spoken version can be obtained utilizing one of the numerous existing algorithms for the determination of the pitch of speech signals (L. R. Rabiner et al. A Comparative Performance Study of Several Pitch Detection Algorithms, IEEE Trans. Acoust. Speech and Signal Process, Volume. ASSP 24, pp. 399–417 Oct. 1976. B. Secrest, G. Doddington, Post Processing Techniques For Voice Pitch Trackers —Procs. of the ICASSP 1982. Paris pp. 172–175).

The spoken and synthetic versions are then compared utilizing a dynamic programming technique operating on the spectral distances in a manner which is now classic in global speech recognition (H. Sakoe et S. Chiba —Dynamic Programming Algorithm Optimisation For Spoken Word Recognition IEEE Trans. ASSP 26-1, Fev. 1978).

This technique is also called dynamic time warping since it provides an element by element correspondence (or projection) between the two versions of the message so that the total spectral distance between them is minimized.

In regard to FIG. 1, the abscissa shows the phonetic units $up_1$–$up_5$ of the synthetic version of a message and the ordinant shows the spoken version of the same message, the segments $s_1$–$s_5$ of which correspond respectively to the phonetic units $up_1$–$up_5$ of the synthetic version.

In order to correlate the duration of the synthetic version with that of the spoken version, it suffices to adjust the duration of each phonetic unit to make it equal in duration to each segment corresponding to the spoken version.

After this adjustment, since the durations are equal, the pitch of the synthetic version can be rendered equal to that of the spoken version simply by rendering the pitch of each frame of the phonetic unit equal to the pitch of the corresponding frame of the spoken version.

The prosody is then composed of the duration warping to apply to each phonetic unit and the pitch contour of the spoken version.

There will now be examined the encoding of the prosody. The prosody can be coded in different manners depending upon the fidelity/bit rate compromise which is required.

A very accurate way of encoding is as follows.

For each frame of the phonetic units, the corresponding optimal path can be vertical, horizontal or diagonal.

If the path is vertical, this indicates that the part of the spoken version corresponding to this frame is elongated by a factor equal to the length of the path in a certain number of frames.

Conversely, if the path is horizontal, this means that all of the frames of the phonetic units under that portion of the path must be shortened by a factor which is equal to the length of the path. If the path is diagonal, the frames corresponding to the phonetic units should keep the same length.

With an appropriate local constraint of the time warping, the length of the horizontal and vertical paths can be reasonably limited to three frames. Then, for each frame of the phonetic units, the duration warping can be encoded with three bits.

The pitch of each frame of the spoken version can be copied in each corresponding frame of the phonetic units using a zero or one order interpolation.

The pitch values can be efficiently encoded with six bits.

As a result, such a coding leads to nine bits per frame for the prosody.

Assuming there is an average of forty frames per second, this entails about four hundred bits per second, including the phonetic code.

A more compact way of coding can be obtained by using a limited number of characters to encode both the duration warping and the pitch contour.

Such patterns can be identified for segments containing several phonetic units.

A convenient choice of such segments is the syllable. A practical definition of the syllable is the following:

[(consonant cluster)] vowel [(consonant cluster)] [ ]=optional.

A syllable corresponding to several phonetic units and its limits can be automatically determined from the written form of the message. Then, the limits of the syllable can be identified on the spoken version. Then if a set of characteristic syllable pitch contours has been selected as representative patterns, each of them can be compared to the actual pitch contour of the syllable in the spoken version and there is then chosen the closest to the real pitch contour.

For example, if there were thirty-two characters, the pitch code for a syllable would occupy five bits.

In regard to the duration, a syllable can be split into three segments as indicated above.

The duration warping factor can be calculated for each of the zones as explained in regard to the previous method.

The sets of three duration warping factors can be limited to a finite number by selecting the closest one in a set of characters.

For thirty-two characters, this again entails five bits per syllable.

The approach which has just been described requires about ten bits per syllable for the prosody, which entails a total of 120 bits per second including the phonetic code.

Figure 2:
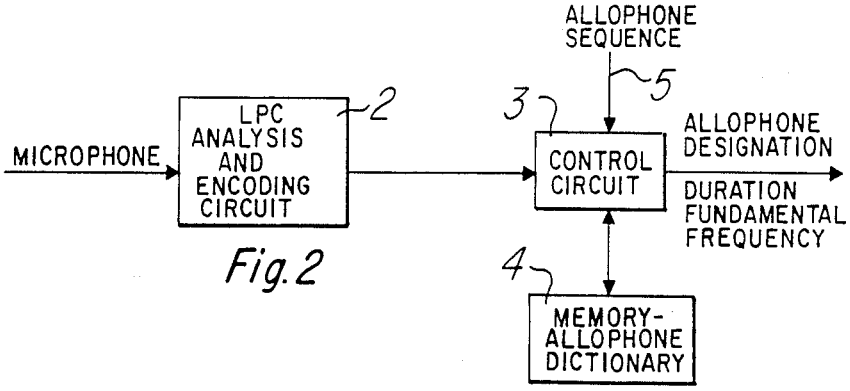
FIG. 2 is a schematic view of a speech encoding device utilizing the process according to the invention.

In FIG. 2, there is shown a schematic of a speech encoding device utilizing the process according to the invention.

The input of the device is the output of a microphone.

The input is connected to the input of a linear prediction encoding and analysis circuit 2; the output of the circuit 2 is connected to the input of an adaptation algorithm operating circuit comprising a control circuit 3.

Another input of control circuit 3 is connected to the output of memory 4 which constitutes an allophone dictionary.

Finally, over a third input 5, the adaptation algorithm operating circuit or control circuit 3 receives the sequences of allophones. The control circuit 3 produces at its output an encoded message containing the duration and the pitches of the allophones.

To assign a phrase prosody to an allophone chain, the phrase is registered and analysed in the control circuit 3 utilizing linear prediction encoding.

The allophones are then compared with the linear prediction encoded phrase in control circuit 3 and the prosody information such as the duration of the allophones and the pitch are taken from the phrase and assigned to the allophone chain.

With the data rate coming from the microphone to the input of the circuit 2 of FIG. 2 being for example 96,000 bits per second, the available corresponding encoded message at the output of the control circuit 3 will have a rate of 120 bits per second.

The distribution of the bits is as follows.

Five bits for the designation of an allophone/-phoneme (32 values).

Three bits for the duration (8 values).

Five bits for the pitch (32 values).

This makes up a total of thirteen bits per phoneme.

Taking into account that there are on the order of 9 to 10 phonemes per second, a rate on the order of 120 bits per second is obtained.

Figure 3:
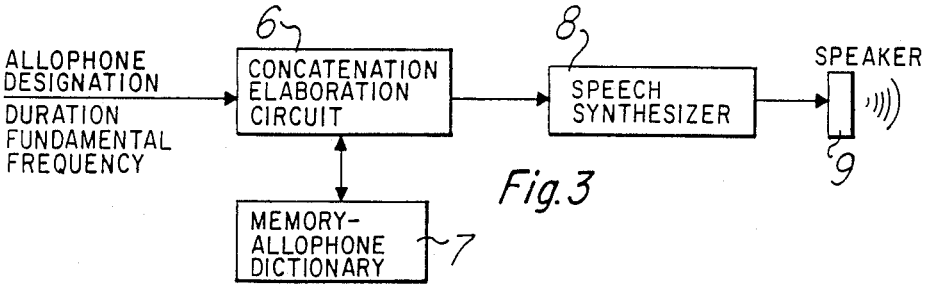
FIG. 3 is a schematic view of a decoding device for a message coded according to the process of the invention.

The circuit shown in FIG. 3 is the decoding circuit for the signals generated by the control circuit 3 of FIG. 2.

This device includes a concatenation algorithm elaboration circuit 6 one input being adapted to receive the message encoded at 120 bits per second.

At another input, the circuit 6 is connected to an allophone dictionary 7. The output of circuit 6 is connected to the input of a synthesizer 8 for example, of the type TMS 5200 A. available from Texas Instruments Incorporated of Dallas, Texas. The output of the synthesizer 8 is connected to a loudspeaker 9.

Circuit 6 produces a linear prediction encoded message having a rate of 1.800 bits per second and the synthesizer 8 converts, in turn, this message into a message having a bit rate of 64.000 bits per second which is usable by loudspeaker 9.

For the English language, there has been developed an allophone dictionary including 128 allophones of a length between 2 and 15 frames, the average length being 4 or 5 frames.

For the French language, the allophone concatenation method is different in that the dictionary includes 250 stable states and this same number of transitions.

The interpolation zones are utilized for rendering the transitions between the allophones of the English dictionary more regular.

The interpolation zones are also utilized for regularizing the energy at the beginning and at the end of the phrases. To obtain a data rate of 120 bits per second, three bits per phoneme are reserved for the duration information.

The duration code is the ratio of the number of frames in the modified allophone to the number of frames in the original. This encoding ratio is necessary for the allophones of the English language as their length can vary from one to fifteen frames.

On the other hand, as the totality of transitions plus stable states in the French language has a length of four to five frames, their modified length can be equal to two to nine frames and the duration code can be a number of frames in the totality of stable states plus modified transitions.

The invention which has been described provides for speech encoding with a data rate which is relatively low with respect to the rate obtained in conventional processes.

The invention is therefore particularly applicable for books with pages including in parallel with written lines or images, an encoded corresponding text which is reproduceable by a synthesizer.

The invention is also advantageously used in video text systems developed by the applicant and in particular in devices for the audition of synthesized spoken messages and for the visualization of graphic messages corresponding to the type described in the French patent application No. FR 8309194, filed 2 June 1983, by the applicant.

I claim:

1. A process for encoding digital speech information to represent human speech as audible synthesized speech with a reduced speech data rate while retaining speech quality in the reproduction of the encoded digital speech information as audible synthesized speech, said process comprising:

encoding a sequence of input data in the form of a plurality of phonological linguistic units representative of a written version of a message to be coded to provide a first encoded speech sequence corresponding to the written version of the message to be coded;

encoding a second sequence of input data derived from a spoken version of the same message to which the written version pertains in the form of a plurality of phonological linguistic units and intonation parameters corresponding thereto, wherein the phonological linguistic units are equivalent to the phonological linguistic units of said first encoded speech sequence, thereby providing a second encoded speech sequence including intonation parameters of the speech as a portion thereof and corresponding to the spoken version of the message to be coded;

combining with the first encoded speech sequence corresponding to the written version of the message to be coded, the portion of the second encoded speech sequence corresponding to the spoken version of the message to be coded which includes the intonation parameters of the speech; and producing a composite encoded speech sequence corresponding to the message from the combination of the first encoded speech sequence and the encoded intonation parameters of the speech included in the portion of the second encoded speech sequence.

2. A process as set forth in claim 1, wherein the encoding of the second sequence of input data derived from the spoken version of the message in providing the second encoded speech sequence includes encoding the duration and pitch of the phonological linguistic units as the encoded intonation parameters of the speech; and the combining of the first encoded speech sequence and the portion of the second encoded speech sequence includes the use of the encoded duration and pitch of the phonological linguistic units as the encoded intonation parameters of the portion of the second encoded speech sequence.

3. A process as set forth in claim 2, wherein said phonological linguistic units comprise phonemes.

4. A process as set forth in claim 2, wherein said phonological linguistic units comprise allophones.

5. A process as set forth in claim 2, wherein said phonological linguistic units comprise diphones.

6. A process as set forth in claim 1, further including providing a plurality of segment components of the message to be coded from the written version of the message, wherein each of the plurality of segment components comprises one or more phonological linguistic units; and encoding the written version of the message in conformance with the plurality of segment components in providing the first encoded speech sequence in which the plurality of segment components are encompassed.

7. A process as set forth in claim 6, wherein the encoding of the second sequence of input data derived from the spoken version of the message is accomplished by analyzing the second sequence of input data to obtain the phonological linguistic units and intonation parameters corresponding thereto in providing the second encoded speech sequence;

comparing the first encoded speech sequence corresponding to the written version of the message and the second encoded speech sequence corresponding to the spoken version of the message; and determining the proper time alignment between the first and second encoded speech sequences in response to the comparison therebetween.

8. A process as set forth in claim 7, wherein the plurality of segment components of the message to be coded from the written version of the message are provided by concatenating phonological linguistic units which are stored as individual short sound segments in a dictionary; and comparing the spoken version of the message with said concatenated phonological linguistic units via dynamic programming.

9. A process as set forth in claim 8, wherein the dynamic programming is operable on spectral distances to minimize the total spectral distance between the first encoded speech sequence corresponding to the written version of the message and the second encoded speech sequence corresponding to the spoken version of the message.

* * * * *